US009303609B2

(12) United States Patent
Isogai et al.

(10) Patent No.: US 9,303,609 B2
(45) Date of Patent: Apr. 5, 2016

(54) METHOD OF PRODUCING FUEL DISTRIBUTION PIPE

(71) Applicant: OTICS Corporation, Aichi (JP)

(72) Inventors: Eiji Isogai, Hekinan (JP); Takayoshi Ota, Nishio (JP)

(73) Assignee: OTICS CORPORATION, Aichi (JP)

( * ) Notice: Subject to any disclaimer, the term of this patent is extended or adjusted under 35 U.S.C. 154(b) by 544 days.

(21) Appl. No.: 13/834,644

(22) Filed: Mar. 15, 2013

(65) Prior Publication Data

US 2013/0312705 A1 Nov. 28, 2013

(30) Foreign Application Priority Data

May 23, 2012 (JP) ..... 2012-117436

(51) Int. Cl.

| | |
|---|---|
| ***B21K 3/00*** | (2006.01) |
| ***B21D 53/84*** | (2006.01) |
| ***F02M 63/00*** | (2006.01) |
| ***F02M 55/02*** | (2006.01) |

(52) U.S. Cl.

CPC ..... *F02M 63/00* (2013.01); *B21D 53/84* (2013.01); *B21K 3/00* (2013.01); *F02M 55/025* (2013.01); *Y10T 29/49231* (2015.01)

(58) Field of Classification Search

CPC ..... B21D 53/84; B21K 1/00; B21K 3/00; Y10T 29/49231; F02M 55/025; F02M 63/00

See application file for complete search history.

(56) References Cited

FOREIGN PATENT DOCUMENTS

| | | |
|---|---|---|
| EP | 1 273 794 | 1/2003 |
| EP | 2 151 572 | 2/2010 |
| EP | 2 497 938 | 9/2012 |
| GB | 2 416 373 | 1/2006 |
| JP | 2001-329930 | 11/2001 |
| JP | 2011-052554 | 3/2011 |

OTHER PUBLICATIONS

Extended European Search Report issued Apr. 7, 2014 in corresponding European Patent Application No. 13002143.9.

*Primary Examiner* — Teresa M Ekiert

(74) *Attorney, Agent, or Firm* — Wenderoth, Lind & Ponack, L.L.P.

(57) ABSTRACT

A method of producing a fuel distribution pipe includes providing a forged bar made of metal, forming a main bore in the forged bar so as to extend along an axial direction of the forged bar, forming an injector bore having an injector opening in the forged bar, forming a bolt through hole having a bolt opening in the forged bar, obtaining a base pipe having the main bore, the injector bore and the bolt through hole from the forged bar, and bending the base pipe such that the injector opening of the injector bore and the bolt opening of the bolt through hole are provided along a line parallel to the axis of the main bore. The injector bore directly communicates with the main bore and the bolt through hole does not communicates with the main bore.

12 Claims, 6 Drawing Sheets

METHOD OF PRODUCING FUEL DISTRIBUTION PIPE

CROSS REFERENCE TO RELATED APPLICATION

This application claims priority from Japanese Patent Application No. 2012-117436 filed on May 23, 2012. The entire contents of the priority application are incorporated herein by reference.

FIELD OF THE INVENTION

The present disclosure relates to a method of producing a fuel distribution pipe.

BACKGROUND OF THE INVENTION

For example, a known fuel distribution pipe used in an internal-combustion engine includes a pipe, a bolt attachment portion, and an injector attachment portion. The pipe includes a pipe bore through which fuel flows. The pipe is fixed to a cylinder head with a bolt that is passed through a bolt through hole of the bolt attachment portion. The injector attachment portion includes an injector bore that communicates with the pipe bore. An injector is attached to the injector attachment portion such that the fuel can be supplied from the pipe to the injector through the injector bore.

SUMMARY OF THE INVENTION

A technology described herein relates to a method of producing a fuel distribution pipe to be attached to a cylinder head. The method includes providing a forged bar made of metal, forming a main bore in the forged bar so as to extend along an axial direction of the forged bar, forming an injector bore having an injector opening in the forged bar, forming a bolt through hole having a bolt opening in the forged bar, obtaining a base pipe having the main bore, the injector bore, and the bolt through hole from the forged bar, and bending the base pipe such that the injector opening of the injector bore and the bolt opening of the bolt through hole are provided along a line parallel to the axis of the main bore. Fuel is allowed to flow through the main bore. The injector bore directly communicates with the main bore. The injector bore is configured to receive an injector therein through the injector opening. The bolt through hole does not communicate with the main bore. A bolt is passed through the bolt through hole to fix the pipe to the cylinder head.

DETAILED DESCRIPTION OF THE PREFERRED EMBODIMENTS

In the above-described related art, the injector bore intersects with the pipe bore, but the bolt through hole does not intersect with the pipe bore and is located outwardly away from the pipe bore. In such a configuration, if a reaction force is applied to the pipe from the cylinder side at the time of injection, a force is generated to rotate the pipe on the bolt attachment portion. This may cause an uplift of the pipe. This problem may be solved by providing the bolt attachment portion and the injector attachment portion such that axes thereof intersect with a line that is parallel to a longitudinal direction of the pipe. Accordingly, a rotation force around the bolt bore is not generated and the uplift of the pipe is less likely to occur.

To obtain the fuel distribution pipe having such an arrangement of the bolt attachment portion and the injector attachment portion, the injector bore may be provided to intersect with the longitudinal direction extending through the bolt bore. However, since the bolt bore does not intersect with the pipe bore, the injector bore does not intersect with the pipe bore. Thus, a communication hole is necessary to be formed to communicate the injector bore and the pipe bore. In the formation of the communication hole, a drilling from an inside of the bore of the injector attachment portion in a diagonal direction is required. This lowers productivity and workability. In addition, the formation of the communication hole may generate a burr at an intersection between the communication hole and the pipe bore. This burr may not be easily visible from an opening of the injector bore, because the intersection is located at the most remote end of the communication hole from the opening of the injector bore. Accordingly, the burr may be difficult to be removed.

A method according to the present technology and a fuel distribution pipe produced by the method will be explained with reference to FIGS. 1 to 6. Herein, a fuel delivery pipe 10 is used as one example of the fuel distribution pipe produced by the method. Fuel is supplied from a fuel tank in an automobile to the fuel delivery pipe 10 and the fuel delivery pipe 10 distributes the fuel to injectors.

Figure 2:
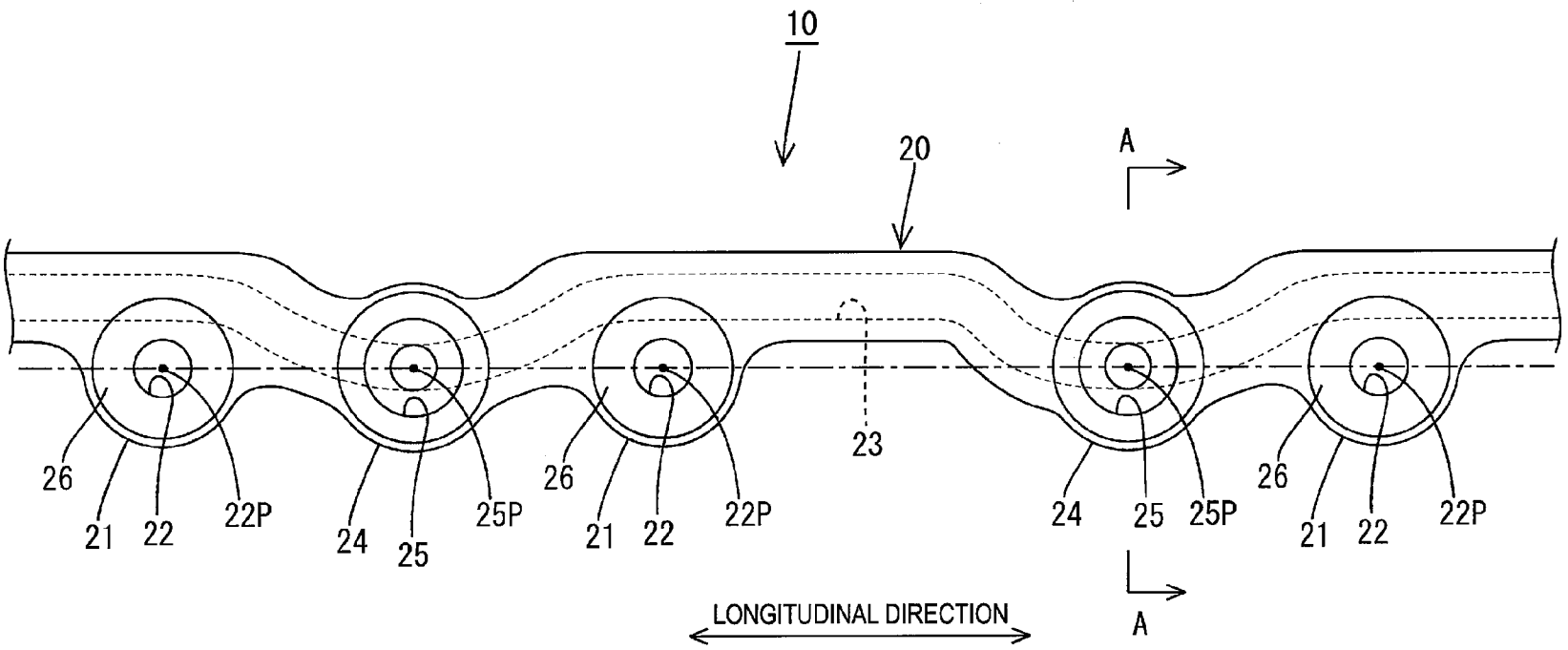
FIG. 2 is a bottom view of a fuel delivery pipe produced according to a method of the present technology.

As illustrated in FIG. 2, the fuel delivery pipe 10 includes a tubular pipe 20. The pipe 20 includes a plurality of bolt attachment portions 21 and a plurality of injector attachment portions 24. The bolt attachment portions 21 each includes a bolt through hole 22 extending through the bolt attachment portion 21. The pipe 20 is fixed to a cylinder head with a bolt (not illustrated) that is passed through the bolt through hole 22.

The pipe 20 has a pipe bore 23 extending along its axial direction. The pipe bore 23 includes a straight section and a curved section in which the pipe bore 23 extends straightly and curvedly, respectively. The pipe bore 23 and an injector bore 25, which will be described later, communicate with each other at the curved section. Herein, a direction extends parallel with an axis of a main bore 14 of a base pipe 11, which will be described later, is referred to as a longitudinal direction. The longitudinal direction corresponds to a right-left direction in FIGS. 1 and 2. The pipe bore 23 is closed at one end thereof in the longitudinal direction and has an opening at the other end thereof. The pipe 20 is connected to a pipe of the fuel tank at the opening.

The pipe 20 includes the injector attachment portions 24 and an injector is attached to each of the injector attachment portions 24. The number of the injector attachment portions 24 corresponds to that of the cylinders. Each of the injector attachment portions 24 is located between adjacent two of the bolt attachment portions 21 in the longitudinal direction. The adjacent two bolt attachment portions 21 are arranged such that at least one of them is located adjacent to the injector attachment portion 24 in the longitudinal direction.

Figure 3:
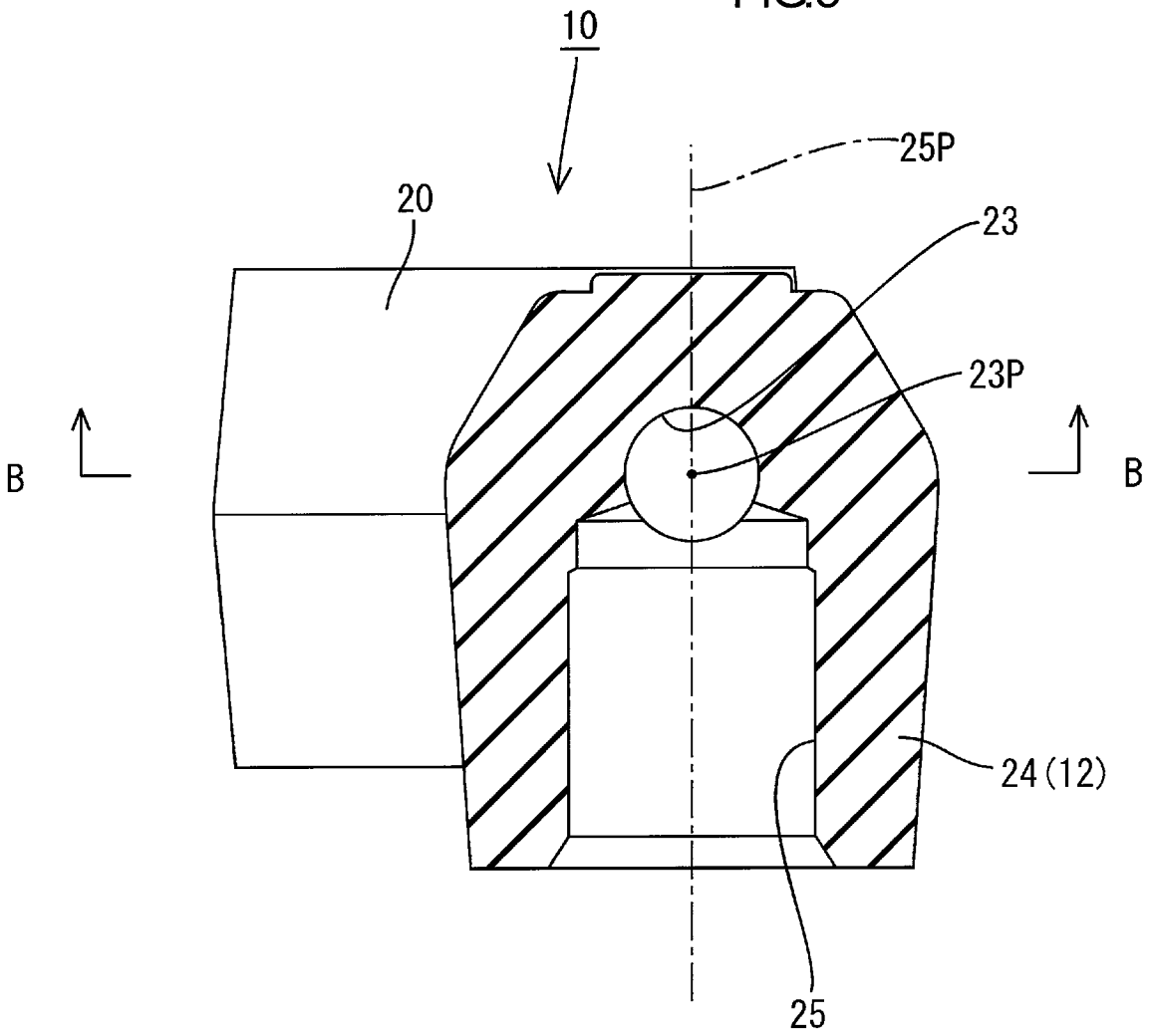
FIG. 3 is a cross-sectional view taken along a line A-A in FIG. 2.

As illustrated in FIG. 3, the injector attachment portion 24 has a hollow cylindrical shape as a whole and has an injector bore 25 extending along its axis. The injector attachment portion 24 has an opening at one end that is a lower end in FIG. 3. The other end of the injector attachment portion 24 configures a part of an outer peripheral surface of the pipe 20. The injector bore 25 is directly connected to the pipe bore 23 to communicate with each other with at a remote end from the opening.

An injector is inserted into the injector bore 25 from the opening of the injector attachment portion 24. The injector is a fuel injection device that injects fuel into the cylinder of an engine. The fuel supplied to the pipe bore 23 is distributed to the injectors through the injector bores 25. Then, the injectors inject the fuel to the cylinders of the engine.

The axis 23P of the pipe bore 23 intersects with the axis 25P of the injector bore 25 at a right angle, and thus the pipe bore 23 and the injector bore 25 are directly connected to communicate with each other. Accordingly, a communication hole that connects the pipe bore 23 and the injector bore 25 is not required.

As illustrated in FIG. 2, an opening of the through hole 22 and an opening of the injector bore 25 are provided on a line parallel to the longitudinal direction of the pipe 20. The axis 22P of the bolt through hole 22 and the axis 25P of the injector bore 25 are intersect with a line parallel to the longitudinal direction of the pipe 20. In other words, when the pipe 20 is viewed along its longitudinal direction, the axis 22P of the bolt through hole 22 and the axis 25P of the injector bore 25 are overlapped with each other. Also, a center of the bolt through hole 22 and a center of the injector bore 25 are provided on a line parallel to the longitudinal direction of the pipe 20. In addition, when the pipe 20 is viewed along a direction perpendicular to the longitudinal direction, the bolt attachment portions 21 and the injector attachment portions 24 are alternately arranged in the longitudinal direction.

In this configuration, the opening of the bolt through hole 22 and the opening of the injector bore 25 are provided on the line parallel to the longitudinal direction of the pipe 20. Each of the axis 22P of the bolt through hole 22 and the axis 25P of the injector bore 25 intersects with the longitudinal direction and intersects with a line parallel to the longitudinal direction. The center of the bolt through hole 22 and the center of the injector bore 25 are provided on the line parallel to the longitudinal direction of the pipe 20. Accordingly, even if a reaction force from the cylinder side is applied to the pipe 20 through the injector attachment portion 24 at the time of injection of the fuel, a force to rotate the pipe 20 about the bolt through hole 22 is hardly generated. Therefore, the uplift of the pipe 20 is less likely to occur.

As illustrated in FIG. 3, the axis 25P of the injector bore 25 intersects with the axis (a center) 23P of the pipe bore 23 at a right angle, and thus the injector bore 25 and the pipe bore 23 are directly connected to communicate with each other. On the other hand, as illustrated in FIG. 2, the bolt through hole 22 does not communicate with the pipe bore 23. The bolt attachment portion 21 is obtained by forming the bolt through hole 22 extending through an extended portion 13 of the pipe 20. The extended portion 13 continuously extends in a lateral direction (in a lower direction in FIG. 1) from the pipe. In this configuration, the fuel flowing in the pipe bore 23 does not leak from the bolt through hole 22, which does not communicate with the pipe bore 23. The bolt attachment portion 21 includes a receiving surface 26 of the bolt at a portion around an opening of the bolt through hole 22.

The fuel delivery pipe 10 produced by the method according to the present technology has the above-described configuration. Next, the method of producing the fuel delivery pipe 10 is explained.

Figure 1:
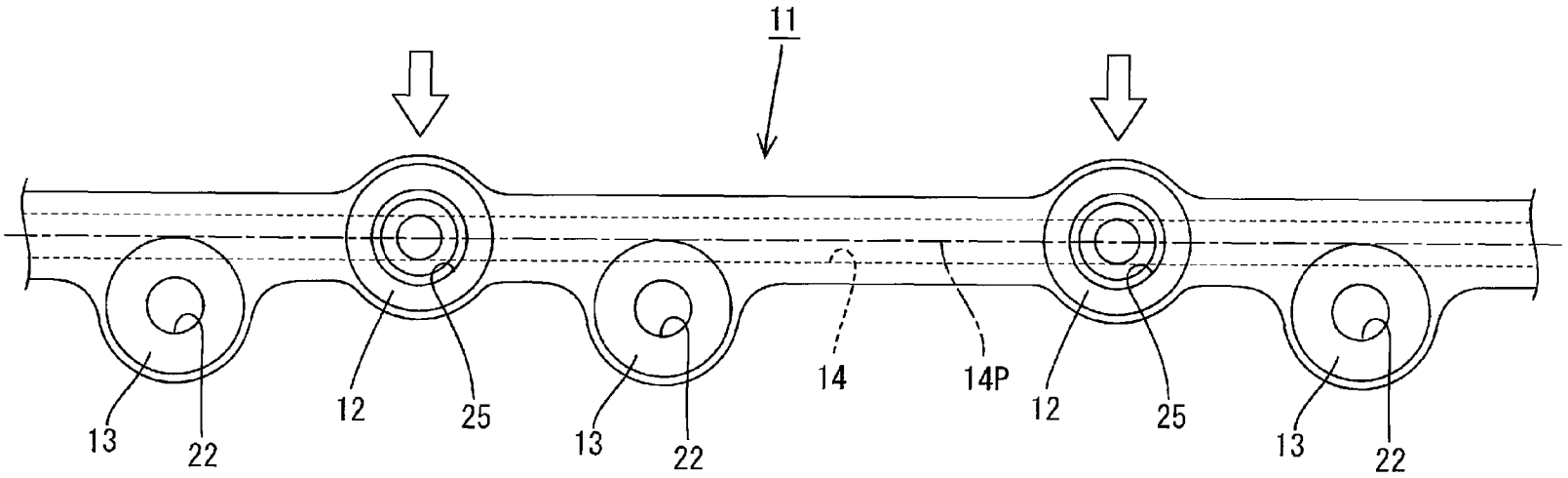
FIG. 1 is a bottom view of a base pipe.

Initially, a forged bar that is formed in substantially a tubular shape is provided as a base material for the pipe 20. The forged bar is made of an iron material such as carbon steel material. The forged bar includes the cylindrical extended portion 13 extending in a direction perpendicular to the longitudinal direction, i.e., in a lower direction in FIG. 1, and a cylindrical protruded portion 12 extending in a lower direction in FIG. 3. The forged bar is machined with a drill or a milling machine to obtain a base pipe 11 as illustrated in FIG. 1. Specifically, the forged bar is drilled along its axis to obtain a main bore 14. The main bore 14 corresponds to the pipe bore 23 of the fuel delivery pipe 10. The protruded portion 12 of the forged bar is drilled from a lower end thereof along its axis to obtain the injector bore 25 that communicates with the main bore 14 (see FIG. 3). The extended portion 13 of the forged bar is drilled along its axis to obtain the bolt thorough hole 22 that does not communicate with the main bore 14. The inner wall of the bolt through hole 22 is away from the inner wall of the main bore 14 by at least 3 mm.

As illustrated in FIG. 3, the forged material is drilled at a right angle with respect to the axis 14P of the main bore 14 to obtain the injector bore 25. Thus, a step to form a diagonal communication hole is not required. This improves the productivity and workability. In addition, an intersection between the main bore 14 and the injector bore 25 is positioned at a most remote end of the injector bore 25 from its opening, and thus the intersection is easily visible. This facilitates deburring, even if a burr is formed at the intersection.

Figure 4:
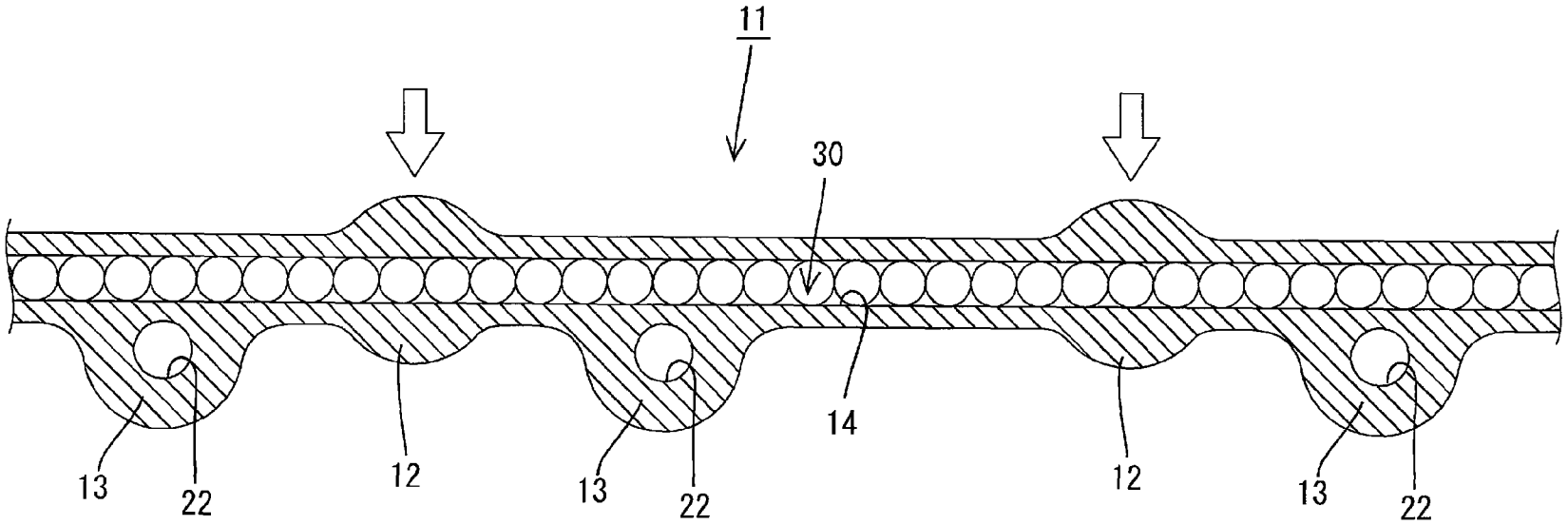
FIG. 4 is a cross-sectional view of the base pipe including a main bore in which a diameter retaining member is provided.
Figure 5:
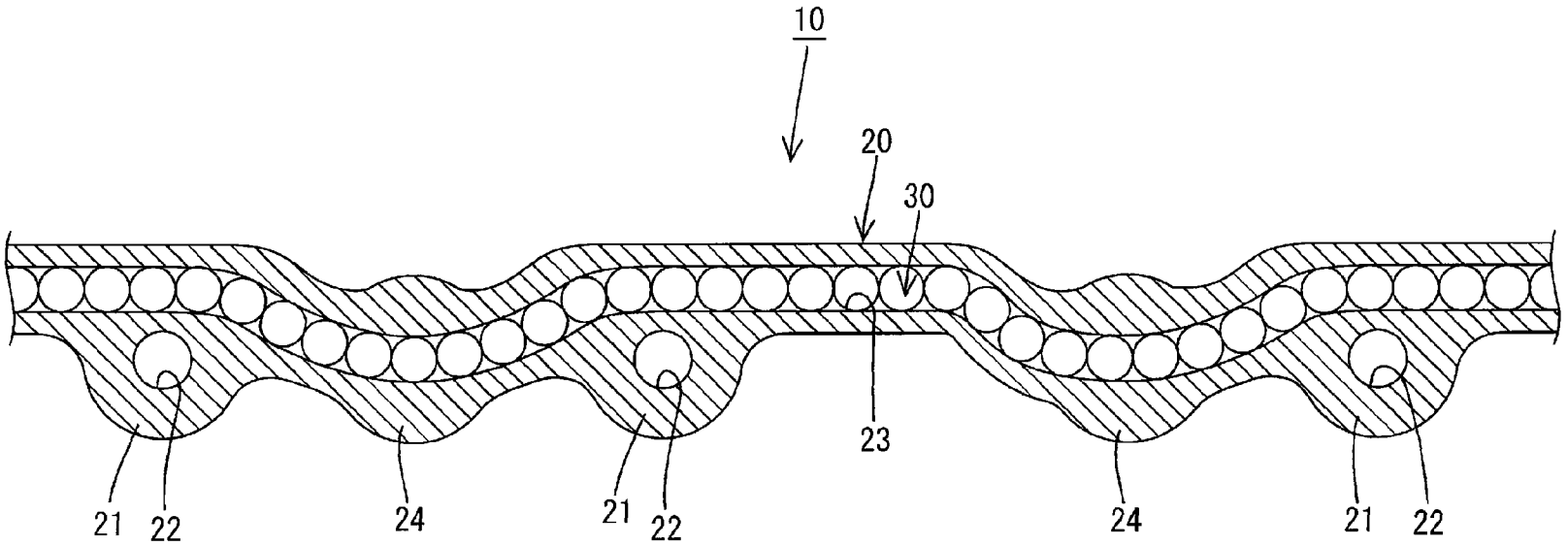
FIG. 5 is a cross-sectional view of the base pipe in FIG. 4 that is bent at the injector attachment portion.
Figure 6:
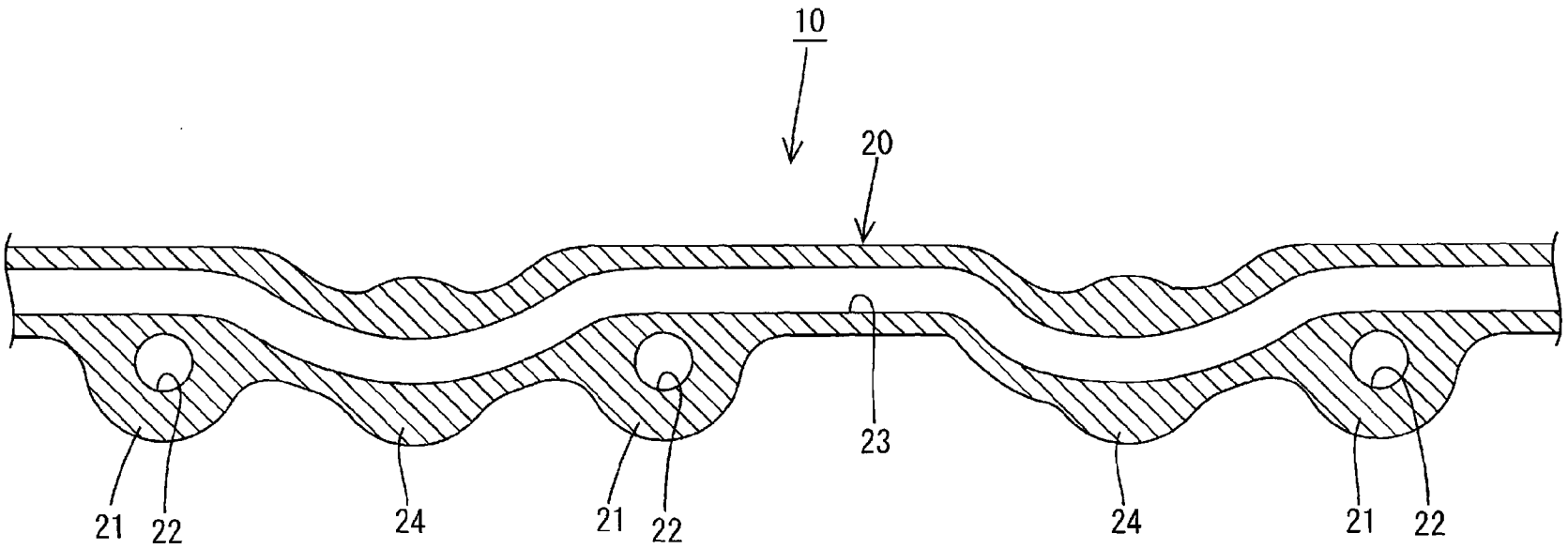
FIG. 6 is a cross-sectional view taken along a B-B line in FIG. 3 and illustrating the base pipe in which the diameter retaining member is removed from the base pipe illustrated in FIG. 5.

Then, as illustrated in FIG. 4, a diameter retaining member 30 is inserted into the main bore 14 of the base pipe 11. The diameter retaining member 30 has an outer diameter that is substantially equal to an inner diameter of the main bore. The diameter retaining member 30 includes a plurality of metal balls. The metal balls are connected in a displaceable manner relative to each other through a link, for example. The base pipe 11 holding the diameter retaining member 30 in the main bore 14 is pressed in a direction perpendicular to the longitudinal direction of the main bore 14 at the injector attachment portion 24. The base pipe 11 is pressed until the axis of the injector bore 25P intersects with a line parallel to the longitudinal direction that passes through the axis of the attachment bore 22P. The base pipe 11 is pressed in the direction indicated by two outlined arrows in FIG. 4. As illustrated in FIG. 5, this converts the main bore 14 of the base pipe 11 to the pipe bore 23 of the pipe 20. In this state, as illustrated in FIG. 2, each of the axis 22P of the bolt through hole 22 and the axis 25P of the injector bore 25 intersects with the line parallel to the longitudinal direction of the pipe 20. Namely, the center of the bolt through hole 22 and the center of the injector bore 25 are provided on the line parallel to the longitudinal direction of the pipe 20. Subsequently, the diameter retaining member 30 is removed from the pipe bore 23. As illustrated in FIG. 6, the pipe bore 23 having the same diameter as the main bore 14 is obtained. This method enables the pipe 20 to be formed in any shape.

As described above, according to the method, the bolt through hole 22 and the injector bore 25 are formed in the base pipe 11, and then the base pipe 11 is pressed at the protruded portion 12 including the injector bore 25. Thus, the base pipe 11 is bent such that each of the bolt through hole 22 and the injector bore 25 intersects with the line parallel to the axis of the main bore 14. Accordingly, the opening of the bolt through hole 22 and the opening of the injector bore are provided on the line parallel to the longitudinal direction of the pipe 20. Further, the center of the bolt through hole 22 and the center of the injector bore 25 are provided on the line parallel to the longitudinal direction of the pipe 20. With this configuration, the pipe 20 is hardly rotated upon the injection of fuel. In addition, the axis 25P of the injector bore 25 and the axis 23P (the center) of the pipe bore 23 intersect with each other at a right angle. In this configuration, the injector bore 25 and the pipe bore 23 are directly connected to communicate with each other. Thus, even if a burr is generated at the intersection between the injector bore 25 and the pipe bore 23, the burr can be easily removed.

Other Embodiments

The present invention is not limited to the embodiment as described above with reference to the drawings.

(1) The axis 23P (the center) of the pipe bore 23 and the axis 25P of the injector bore 25 may not intersect at a right angle, but may be arranged at any angle on the same plane.

(2) The base pipe may not be bent at the injector attachment portion 24. The base pipe may be bent at the bolt through hole 22, or at both of the injector bore 25 and the bolt through hole 22.

(3) The diameter retaining members is not limited to the metal balls. Any diameter retaining member that can retain diameter of the main bore may be used.

(4) The metal balls of the diameter retaining member 30 may not be connected to each other. Metal balls that are not connected to each other may be used as the diameter retaining member. In such a case, both ends of the main bore 14 may be closed with covers during the bending step.

(4) The forged bar may not be bent by a press. The forged bar may be bent by a forging.

(5) One injector attachment portion 24 may not be located between two bolt attachment portions 21. Only one bolt attachment portion may be provided for one injector attachment portion.

(6) The fuel delivery pipe may not be the fuel delivery pipe 10 for a gasoline engine. The fuel delivery pipe may be a common rail for a diesel engine.

The invention claimed is:

1. A method of producing a fuel distribution pipe to be attached to a cylinder head, the method comprising:

providing a forged bar made of metal;

forming a main bore in the forged bar so as to extend along an axial direction of the forged bar, the main bore through which fuel is allowed to flow;

forming an injector bore in the forged bar, the injector bore having an injector opening and directly communicating with the main bore, the injector bore being configured to receive an injector therein through the injector opening;

forming a bolt through hole in the forged bar, the bolt through hole having a bolt opening and not communicating with the main bore, the bolt through hole through which a bolt is to be passed to fix the pipe to the cylinder head;

obtaining a base pipe having the main bore, the injector bore, and the bolt through hole from the forged bar; and bending the base pipe such that the injector opening of the injector bore and the bolt opening of the bolt through hole are provided along a line parallel to an axis of the main bore.

2. The method of producing a fuel distribution pipe according to claim 1, wherein the bending step includes bending a portion of the base pipe in which the injector bore is formed such that the injector opening and the bolt opening are provided along the line parallel to the axis of the main bore.

3. The method of producing a fuel distribution pipe according to claim 1, wherein the base pipe is bent such that an axis of the injector bore and an axis of the bolt through hole intersect with the axis of the main bore of the base pipe.

4. The method of producing a fuel distribution pipe according to claim 1, wherein the base pipe is bent such that a center of the injector opening and a center of the bolt opening are provided along the line parallel to the axis of the main bore.

5. The method of producing a fuel distribution pipe according to claim 1, wherein the forged bar includes an extended portion and a protruded portion, the extended portion extends away from the main bore and the bolt through hole is formed in the extended portion, and the injector bore is formed in the protruded portion.

6. The method of producing a fuel distribution pipe according to claim 1, further comprising:

inserting a diameter retaining member into the main bore of the base pipe before the bending step, the diameter retaining member maintaining a diameter of the main bore during the bending step; and removing the diameter retaining member from the main bore after the bending step.

7. The method of producing a fuel distribution pipe according to claim 6, wherein the diameter retaining member has an outer diameter that is substantially equal to an inner diameter of the main bore.

8. The method of producing a fuel distribution pipe according to claim 6, wherein the diameter retaining member includes a plurality of metal balls connected with each other via a link.

9. The method of producing a fuel distribution pipe according to claim 1, wherein the forming step of forming the injector bore includes drilling the forged bar at a right angle with respect to the main bore.

10. The method of producing a fuel distribution pipe according to claim 1, wherein the base pipe is bent such that an axis of the injector bore and an axis of the bolt through hole are parallel with each other.

11. The method of producing a fuel distribution pipe according to claim 1, wherein the bending step includes pressing the base pipe to be bent.

12. The method of producing a fuel distribution pipe according to claim 1, wherein the forming step of forming the bolt through hole includes forming a plurality of bolt through holes, and the forming step of forming the injector bore includes forming a plurality of injector bores, each of the injector bores being formed between an adjacent pair of the bolt through holes.

* * * * *